US005579959A

United States Patent [19]

Bennett et al.

[11] Patent Number: 5,579,959

[45] Date of Patent: Dec. 3, 1996

[54] VISCOUS FOOD PRODUCTS HOUSING, PUMP, DISPENSER, AND VALVE APPARATUS

[75] Inventors: Paul A. Bennett, St. Louis; James W. Brown, St. Charles; Michael Petrushko, St. Louis, all of Mo.

[73] Assignee: Star Manufacturing International, Inc., St. Louis, Mo.

[21] Appl. No.: 442,021

[22] Filed: May 16, 1995

[51] Int. Cl.[6] ..... B67D 5/40

[52] U.S. Cl. ..... 222/385

[58] Field of Search ..... 222/148, 372, 222/383.1, 385, 382, 381, 380; 251/284; 137/533.11; 417/569

[56] References Cited

U.S. PATENT DOCUMENTS

| | | | |
|---|---|---|---|
| 1,307,478 | 6/1919 | Berdahl | 222/385 |
| 1,554,855 | 9/1925 | Johnson et al. | 222/381 |
| 2,022,208 | 11/1935 | Lacke . | |
| 2,102,837 | 12/1937 | Davis . | |
| 2,205,875 | 6/1940 | Coffey et al. . | |
| 2,662,256 | 12/1953 | Gagne . | |
| 2,681,009 | 6/1954 | Titus . | |
| 2,765,963 | 10/1956 | Langguth . | |
| 2,811,284 | 10/1957 | Rogers . | |
| 2,818,028 | 12/1957 | Berman . | |
| 2,837,246 | 6/1958 | Steele . | |
| 3,106,320 | 10/1963 | Campbell et al. . | |
| 3,191,807 | 6/1965 | Rodrigues, Jr. . | |
| 3,317,141 | 5/1967 | Mann . | |
| 3,332,585 | 7/1967 | Cox . | |
| 3,452,901 | 7/1969 | Roach | 222/385 |
| 3,777,943 | 12/1973 | Spaulding et al. . | |
| 4,474,214 | 10/1984 | Iannelli . | |
| 4,869,404 | 9/1989 | Elliott . | |
| 5,285,815 | 2/1994 | Henry et al. . | |
| 5,375,746 | 12/1994 | Schaefer et al. . | |
| 5,381,932 | 1/1995 | Humphrey | 222/385 |

FOREIGN PATENT DOCUMENTS

| | | | |
|---|---|---|---|
| 516855 | 1/1940 | United Kingdom | 222/385 |
| 688150 | 3/1953 | United Kingdom | 222/385 |

OTHER PUBLICATIONS

Description FIG. 1 of Initial IDS Author Star Manufacturing International, Inc. Title Product Photograph Date At least as early as 1992 Pertinent pages all.

Description FIG. 2 of Initial IDS, and additional p. 11 attached as Ex. 1 hereto Author Server Products, Inc. Title Product Photograph and Description Date At least as early as 1992 Pertinent pp. 10,11.

Description Ex. 2 (attached hereto) Author Star Manufacturing International, Inc. Title Instruction Sheet and Drawing Date At least as early as May, 1988 Pertinent pages all.

Description Ex. 3 (attached hereto) Author Star Manufacturing International, Inc. Title NSF Documentation with photograph Date Feb. 1993 Pertinent pages all.

*Primary Examiner*—Andres Kashnikow
*Assistant Examiner*—Philippe Derakshani
*Attorney, Agent, or Firm*—Polster, Lieder, Woodruff & Lucchesi

[57] ABSTRACT

In a container for dispensing viscous food product having viscosity such as of ketchup, mustard, melted cheese or the like, is a housing for a pump, a dispenser, and valves. The housing has a pumping chamber and dispensing chamber, with first and second valves associated with the pumping and dispensing chambers, respectively. The pump chamber is sized to receive part of a pump. The dispensing chamber is sized to receive part of a dispenser, which can include a base. An angled flow passage connects the pump chamber to the dispensing chamber. The first and second valves can both include a ball. Structure is provided for checking the upward movement of the first and second valves during pumping and dispensing strokes and to hold the dispenser to the housing, which in a preferred embodiment comprises a U-shaped pin which passes into the dispensing chamber and engages the dispenser, and into the pump chamber. A notch in the side of the housing permits easy grasping of the U-shaped pin. The dispensing chamber has a ledge to support the dispenser base that provides a seal against viscous food product flow around the dispenser.

21 Claims, 2 Drawing Sheets

VISCOUS FOOD PRODUCTS HOUSING, PUMP, DISPENSER, AND VALVE APPARATUS

FIELD OF INVENTION

This invention relates to pumps and dispensers for edible viscous food products having the viscosity of ketchup, mustard, melted cheese or the like, dispensed from a container, and more specifically relates to a pumping and dispensing housing and valve apparatus for dispensing food products with such viscosity.

In the prior art, viscous food product containers with pump and dispenser assemblies have comprised a pumping chamber and dispensing chamber with ball valves contained therein. In one such device, a check pin extends through holes in a pump chamber to check movement of a ball that is part of a valve. Such device also has a separate pin contained within the dispensing chamber to check upward movement of a ball forming a part of a valve assembly. A separate plug holds the latter pin within the dispensing chamber. The plug has another lower pin that interlocks with a projection that extends from the pump tube to be held in position. This design has several deficiencies. It is extremely difficult to clean the lower interior end of the pump tube. Such lack of proper cleaning can lead to gum build up which can promote bacteria growth and decrease pumping efficiency. Such a design further has too many individual parts, including the plug and the separate pins. These parts make the unit more difficult to produce, assemble and to maintain, than with the present invention.

Other viscous food product pumps are known in the prior art, such as shown in U.S. Pat. No. 3,332,5852 to Cox and U.S. Pat. No. 4,869,404 to Elliott. The designs of these patents also lack the advantages of the present invention.

SUMMARY OF INVENTION

The present invention overcomes these serious prior art problems. The present invention generally comprises a housing having a pump chamber and a dispensing chamber for viscous edible food products. The dispensing chamber has an opening that can receive an end of a dispenser. The dispenser can have a spout. The pump chamber has an opening which can receive pump components such as a piston and shaft. A passage such as a conduit connects the pump chamber to an opening in the dispensing chamber to permit the flow of viscous food products between the pump chamber and dispensing chamber. The passage in a preferred embodiment is linear and extends, most preferably, at an angle of about 41° relative to the axis of the pump chamber, and more generally preferably extends at an angle of about 48° to 15° relative to the axis of the pump chamber. The housing has an inlet opening to the pump chamber to allow flow of viscous food products from the container into the pump chamber. The angle of the passage from the pump chamber to the dispenser chamber allows a cleaning device, such as a brush, to be easily inserted through the inlet of the pump chamber and through the angled passage to easily clean the passage. This is an improvement over prior art viscous food product dispensers that have had a horizontal passage connecting a pump chamber to a dispensing chamber, which does not allow for such use in cleaning. The angled passage also allows for the housing to be constructed easily by machine manufacture for a plastic housing by drilling the passage through the pump chamber inlet.

The invention further comprises a valve associated with the pump chamber and a valve associated with the dispensing chamber. The valves operate to open and close during pumping strokes to cause viscous food product to flow through the pump inlet, through the connecting passage to the dispensing chamber, and thence through the dispenser spout.

In a preferred embodiment, a pump valve comprises a ball and a dispenser valve comprises a ball. A single member holds the dispenser to the housing, and also acts as an upward check on the dispenser valve, while further acting as a check on upward movement of the pump valve. In a preferred embodiment the valve check and dispenser lock member is a U-shaped pin which has one leg that passes through the housing through the base of the dispenser and through the dispensing chamber, and which has another leg that passes through the housing into the pump chamber.

A notch in the side of the housing permits easy grasping of the valve check and lock pin to remove it, to disassemble the unit. The use of a single member to lock the dispenser to the housing and to check valve movement also allows for ease in assembly and disassembly.

The invention hence provides many advantages over the prior art by providing for viscous food product pump and dispenser operations with fewer components and installation steps, better and more efficient cleaning of the housing, easier manufacture, assembly and disassembly, and convenient and ease in shipment and storage.

DESCRIPTION OF PREFERRED EMBODIMENT

General Description

Figure 1:
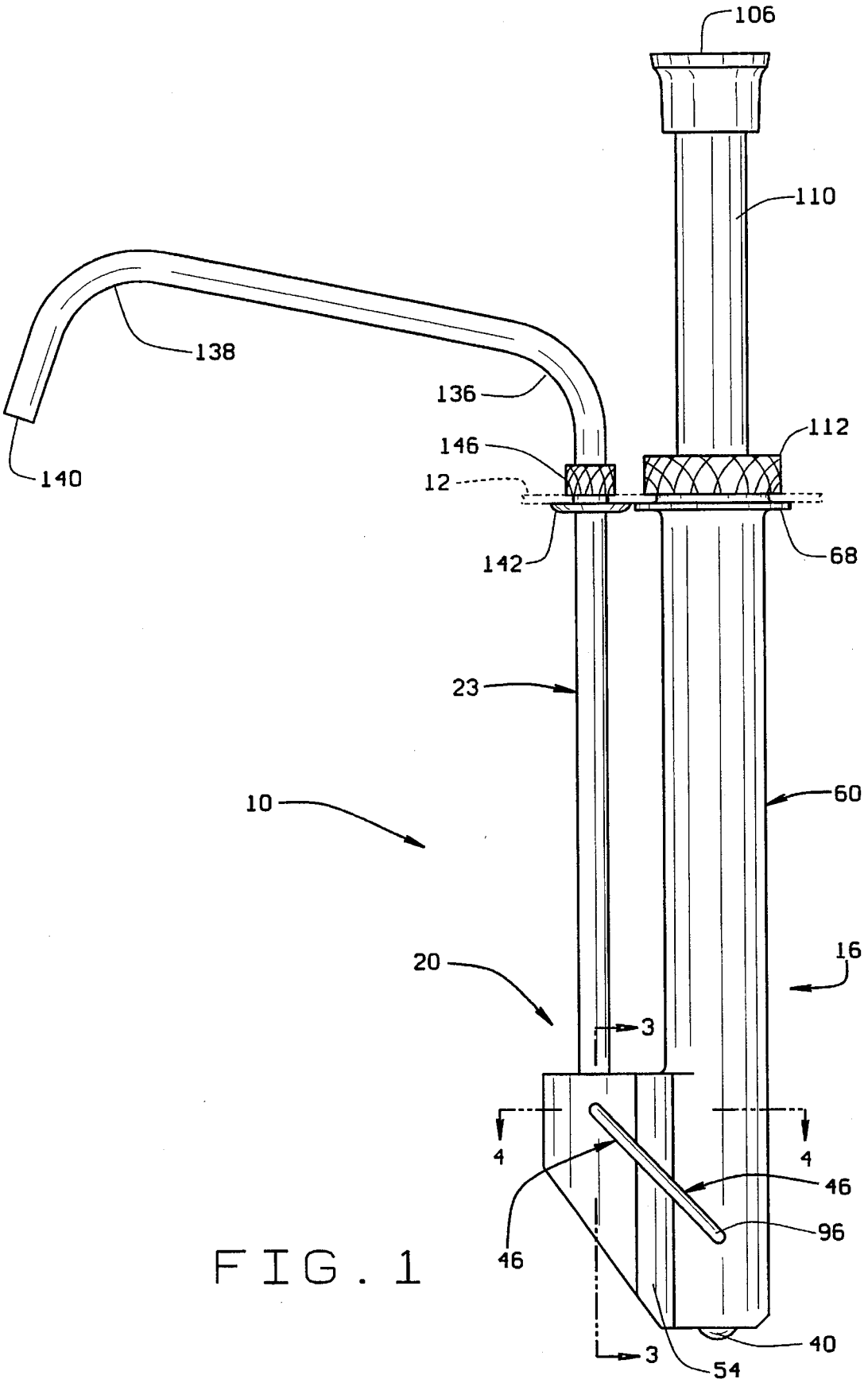
FIG. 1 is a side elevation of the hol sing of the invention, showing the locking and check pin, and parts of the dispenser and pump.

First, a general description of the preferred embodiment will be given, followed by a more detailed description. The drawings show a preferred embodiment of the invention. The pumping and dispensing assembly 10 is mounted to the top wall of a container 12 shown in phantom lines, which holds edible viscous food products such as ketchup, mustard, melted cheese or other edible viscous food products. The viscous food product pumping and dispensing assembly 10 generally comprises a housing 16, a pump assembly 18, and a dispenser 20. Dispenser 20 has a base 22 and a spout tube 23. Housing 16 has a pump chamber 26 which has a lower inlet opening 28. Part of the pump assembly 18 is received within the pump chamber 26. Housing 16 also has a dispensing chamber 30 which has a lower opening 32. The dispenser base 22 is received within the dispensing chamber 30 and sits on a ledge thereof to provide a seal thereabout.

A passage 34 extends at an angle and acts as a viscous food product flow conduit, to allow viscous food product flow from the pump chamber 36 to the dispensing chamber 30. The viscous food product pumping and dispensing assembly 10 further comprises valves 36 and 38 which comprise balls 40 and 42, respectively, which can seat in the pump chamber and dispensing chamber lower openings 28 and 32, respectively.

The viscous food product pump and dispensing assembly 10 further comprises means for checking valve position and means for locking the spout to the housing, shown in the preferred embodiment as a U-shaped pin 46. One leg 48 of U-pin 46 passes through the housing pump chamber 26, while the other U-pin leg 50 passes through the dispensing chamber 30 and through spout base 22. On the upstroke of the pump assembly 18, viscous food product is drawn from the container 12 through pump chamber inlet 28 in to pump chamber 26. During this upstroke, the leg 48 of pin 46 checks upward movement of ball 40. On the pump downstroke, the viscous food product is pumped through the passage conduit 34 through the lower opening 32 around valve ball 42 into the dispensing chamber 30. On the pump upstroke, U-pin leg 50 checks the upward movement of ball 42 to prevent ball 42 from blocking the flow through the spout tube 23. Notches 52 and 54 are provided in the lower sides of housing 16 to permit a finger and thumb to easily grip pin 46 to remove it for disassembly or cleaning.

DETAILED DESCRIPTION OF PREFERRED EMBODIMENT

Now a more detailed description of the preferred embodiment is given. The housing 16 comprises a longer tubular pump housing section 60 and a shorter tubular dispenser housing section 62, which are connected by a middle housing section 64. In the preferred embodiment, the housing 16 is a unitary integral piece which can be of plastic and made by injection molding and/or by machining, or can also be of stainless steel or an aluminum alloy The housing tubular section 60 has a top exterior end 66 with external threads for receiving a nut to be described. An external annular flange 68 is therebeneath, with its upper surface abutting the bottom of viscous food product container top wall 12. Housing tube 60 has an upper internal cylindrical bore 72 that extends downwardly to an inwardly tapered section 74. Tapered section 74 extends downwardly into a smaller internal cylindrical bore 76. Bore 76 extends downward to a tapered section 78 which slopes inwardly toward pump chamber inlet opening 28. The pump chamber 26 thus comprises the pump housing bore 72, the tapered section 74, the bore 76 and the lower tapered section 78. Ball 40, together with opening 28, the surrounding tapered section 78, and housing tubular section 60, operates as valve 36. A pair of holes are located in the walls of pump housing tube section 60 to extend into bore 76, to slidingly and telescopically receive leg 48 of U-pin 46.

Turning now to the dispensing part of the housing 16, the dispenser housing section 62 has an upper cylindrical interior bore 82 which extends downwardly to a horizontal ledge 84 upon which seats the outer part of the bottom of dispenser base 220 The dispensing chamber 30 then extends downwardly from ledge 84 into a cylindrical counterbore 86, and from there extends downwardly into a tapered funnel section 88. Chamber 30 thence extends downwardly into another cylindrical counterbore 90. The bottom of cylindrical counterbore 90 extends into the top of the conduit 34. From that point, conduit 34 extends at an angle downwardly to intersect the bottom of pump chamber bore 76, to thus establish a viscous food product flow path from pump chamber bore 76 through conduit 34 to counterbore 90 and counterbore 86. In the preferred embodiment, the angle of conduit 34 is about 41° relative to the axis of the pump chamber bore 76. The axis of bore 76 extends vertically, in FIG. 2, through the center of bore 76. The conduit 34 can extend at an angle of about 48° to about 15° relative to the axis of the pump chamber bore 76. The range of the angle of conduit 34 relative to the axis of the pump chamber bore 76 can also less preferably extend to as low as 5° in which case the height of the dispensing chamber would be considerably higher than shown.

The tapered chamber section 88 causes ball 42 to seat to close the upper opening in counterbore 90 to block food product flow when no upward force is exerted upon it. The dispenser housing section 62 has a pair of bores extending through opposite facing walls thereof to telescopically and slidingly receive leg 50 of U-pin 48. Ball 42, together with counterbore 90, tapered section 88 and the surrounding housing tubular section 62, operate as valve 36.

Figure 4:
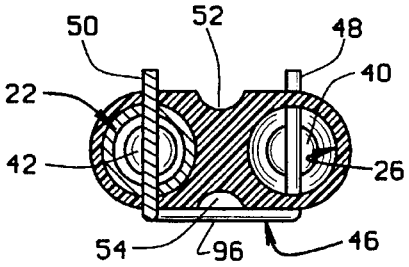
FIG. 4 is a section taken on the line 4—4 of FIG. 1, showing the lock and check pin extending through the housing walls through the pump chamber above the valve ball, and extending through the housing walls through the dispensing chamber and the dispenser base above the dispensing ball valve.
Figure 5:
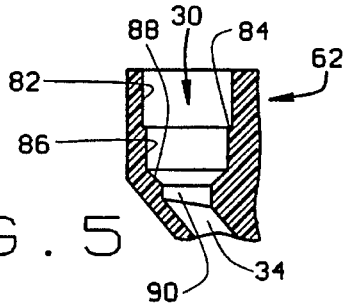
FIG. 5 is a section through part of the housing as in FIG. 2, but without showing the dispenser and the lock and check pin.

As seen in FIGS. 1 and 4, the notches 52 and 54 are of generally semicylindrical shape. Notches 54 and 52 extend longitudinally on the exterior of housing midsection 64. The U-pin 46 has a bite section 96 that connects the two legs 48 and 50, so that pin 96 is an integral unitary piece which can be of metal, such as stainless steel. As seen in FIG. 4, when the legs 48 and 50 extend through the holes in the housing 16, the bite 96 fits flush against the exterior of housing 16, but the notch 54 is sized to permit the finger and thumb to be inserted therein to easily grasp the bite 96. U-pin 46 is shown extending through the housing 16 in one direction in the drawings, but its position can be reversed from that shown. In this reversed position, the bite 96 would be flush against the opposite side of the housing 16, to permit the finger and thumb to fit in the notch 52 to grasp bite 96.

The angled conduit 34 also allows the housing 16 to be made easily of unitary and integral piece, made of plastic by injection molding, or by machining. The manufacture of the conduit 34 of housing 16 by machining can be accomplished by extending a drill bit through the pump chamber inlet opening 28 to drill conduit 34 to connect to dispenser chamber opening 32. In a preferred embodiment the pump chamber inlet 28 can be a hole with a diameter of 0.437 inches (1.11 cm.) and the balls 40 and 42 can be stainless steel spheres with a diameter of 0.5 inches (1.27 cm.). The passage 34 can have a diameter of 0.31 inch (0.79 cm.). The counterbore 90 can have a diameter of 0.437 inches (1.11 cm.) while counterbore 86 can have a diameter of 0.781 inches (1.98 cm.), and bore 82 a diameter of 0.875 inches (2.25 cm.). The diameter of pump chamber bore 76 can be 0.864 inches (2.19 cm.), while the diameter of pump chamber bore 72 can be 0.95 inches (2.41 cm).

The axis of the passage 34 extends to intersect the center of the circular pump inlet opening 28, in the preferred embodiment. This permits a drill bit to be extended through the pump inlet opening 28 to drill the passage 34. It further permits a cleaning instrument such as a brush to be inserted through the inlet 28 and through the passage 34 to the top thereof at the intersection with counterbore 90. More generally and less preferably the axis of passage 34 intersects the pump inlet opening 28 at some point other than the center of that opening 28.

Having now described housing 16, attention is directed to the components of the pump assembly 18. Pump assembly 18 generally has a plunger portion 100 that comprises a cylindrical shaft 102. The top of shaft 102 extends into a smaller cylindrical tip 104 which is threaded at is upper end to receive the threaded bore of a pump handle 106. At the bottom of plunger shaft 102 is a cylindrical piston 105. Piston 105 has an annular groove that receives an O-ring 106 which can be of rubber, plastic or the like. The piston 105 and shaft 100 components can be of metal such as stainless steel, plastic, or the like. The pump assembly 18 further comprises an upper outer sleeve 110 which can be of stainless steel. The upper end of sleeve 110 rests against the bottom of pump handle 106, and the bottom end of sleeve 110 extends through an opening in an annular nut 112 that screws about the exterior threads of pump tube 66. The lower end of sleeve 110 flares outwardly to allow it to hold against the underside of the top wall of nut 112 to resist upward movement therefrom. Within sleeve 110 at the upper end thereof is an inner sleeve 118 whose upper end rest against the inwardly slanting upper end of sleeve 110 to be held against upward movement. Sleeve 118 has a bore and counterbore which slidingly and telescopically receive the upper end of shaft 102 and the smaller shaft tip 104. Pump assembly 18 further comprises an annular washer 122 which can be of metal such as stainless steel, and which has an outer diameter greater than the diameter of tapered section 74 of housing tube 60, to seat thereagainst. Pump assembly 18 further comprises a helical spring 126 which has its upper end resting against the bottom of inner sleeve 118, and it lower end resting against the top of washer 122.

Figure 2:
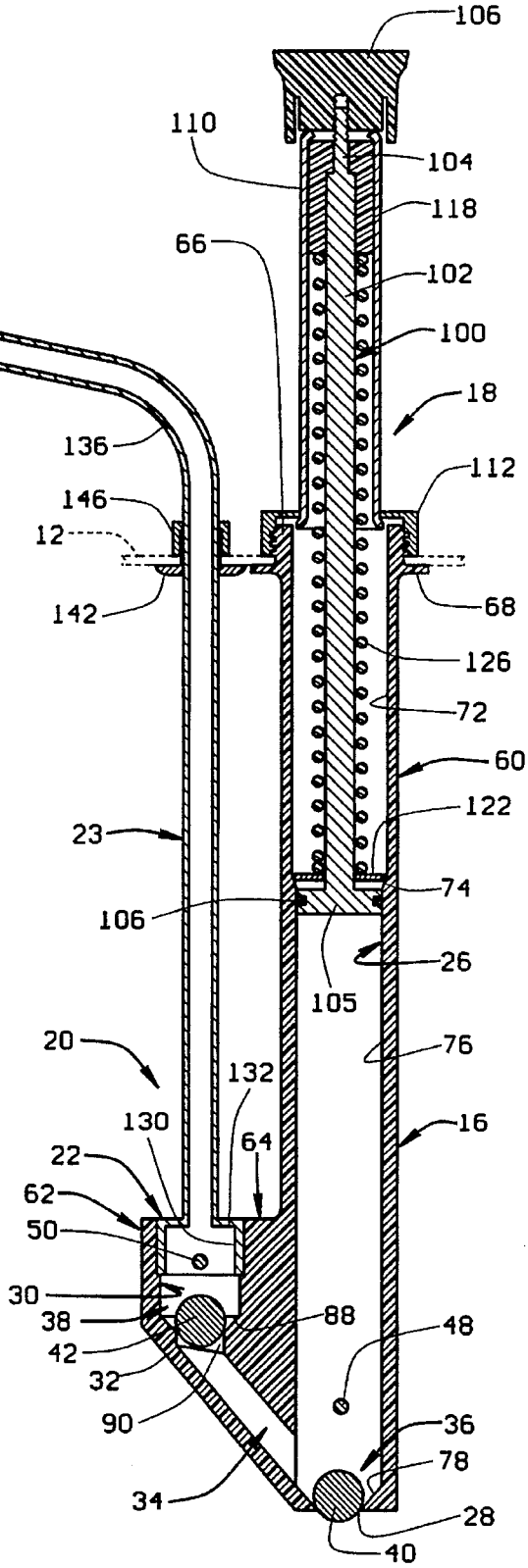
FIG. 2 is a section through the housing, pump and dispenser of FIG. 1, showing the balls that act as part of the valve mechanism, showing the holes through the dispensing and pump chambers and extension of the lock and check pin therethrough, and showing the angled passage connecting the pump chamber to the dispensing chamber.

Thus when the foregoing pump assembly parts are all mounted as shown in FIGS. 1 and 2, the pump handle 106 can be pushed downwardly to force the piston 105 downwardly while washer 122 remains in position. Sleeve 110 moves downwardly with handle 106 until the outer bottom of handle 106 contacts the upper surface of nut 112. Upon release of the handle 106, the force of spring 126 pushes against inner sleeve 118 and outer sleeve 110 to force the handle 106 upwardly during the pump upstroke until handle 106 returns to the FIGS. 1 and 2 position.

Turning now to the dispenser 20, the base 22 has a lower cylindrical walled section 130 that extends upwardly into a horizontal section 132 and thence into spout tube 23. Spout tube 23 extends upwardly and then bends at 136 and 138 to an outlet 140. An annular flange 142 is secured as by spot welding or by being integral with the spout tube 23, to be in fixed position relative thereto. The upper surface of flange 142 abuts the underside of container top wall 112. The spout tube 23 has exterior threads located above flange 142 to which a nut 146 can be threaded. The bottom of nut 146 presses against the top of container upper wall 12, so that together with flange 142 the nut holds spout tube 23 in fixed position.

Figure 3:
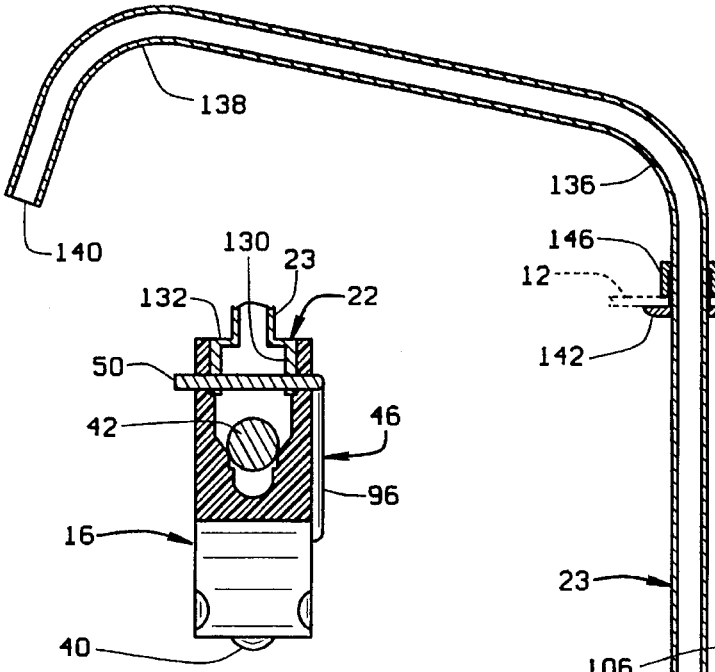
FIG. 3 is a section taken on the line 3—3 of FIG. 1, showing the lock and check pin extending through the housing walls through the dispensing chamber and through the base of the dispenser.

The cylindrical section 130 of dispenser base 22 has a pair of holes extending therethrough, which are aligned with holes of the same diameter through walls of housing tube section 62, as seen in FIGS. 2, 3, and 4. Leg 50 of U-pin 46 extends through the holes in housing tube 62 and said holes in dispenser base section 130, to thus hold the dispenser base 22 within the dispenser chamber 30. The telescopic fit of dispenser base cylindrical walls 130 within the housing tube cylindrical bore 82, along with the seating of the bottom edge of the cylindrical wall 130 against ledge 84, provides a good seal to prevent viscous food product from passing around the exterior of the dispenser base 22 during operation.

In operation, the downward pump stroke moves the pump plunger 100 and its piston 105 downwardly. Then the pump upstroke, through suction, lifts valve ball 40 to permit viscous food product flow through pump chamber inlet 28 into the pump chamber lower bore 76. During this pump upstroke, upward movement of ball 40 is checked by contact with U-pin leg 48. On the pump downstroke, the pressure brought by piston 105 causes ball 40 to seat against pump chamber opening 28, and the downward force of piston 105 forces viscous food product upwardly through conduit 34. The pumping strokes can be repeated. The force of the viscous food product coming through conduit 34 lifts valve ball 42 upwardly so that viscous food product can pass through bore 90 through the dispenser chamber opening 32 into the dispensing chamber 30. During this pump downstroke, the upward movement of valve ball 42 is checked by U-pin leg 50. As a result, ball 42 does not block the lower opening of spout tube 23, so that flow is not blocked through tube 23 and to spout outlet 140. At the same time, U-pin leg 50 acts to retain the dispenser 20 in fixed position relative to the housing 16. The repeated pump stroke action can cause continuous flow of viscous food product out of spout outlet 140.

If it is desired to clean the conduit passage 34, the assembly 10 can be removed from the container 12 by unfastening nuts 112 and 146, and removing the top of container 12. A cleaning instrument such as a brush can be inserted through lower pump chamber opening 28 to extend at an angle through conduit passage 34 into counterbore 906 The brush can be moved back and forth to dislodge any gelled, gummed or solidified viscous food product within conduit 34. The brush can be removed and cleaned and re-inserted until a satisfactory amount of removal.

To disassemble the unit for better cleaning or storage, the U-pin bite 96 is easily grasped by extending the thumb and finger into notch 54 or notch 52 depending upon the position of the U-pin 46, and removing U-pin 46 from housing 16. Dispenser 20 can then be lifted upwardly to remove base 22 from the dispenser chamber 30. Ball 42 can then be removed. The pump assembly nut 112 can be removed to allow the pump assembly to be moved upwardly out of pump chamber 26. Valve ball 40 can then be moved out of the pump chamber 26 for cleaning, and the unit can also be stored following such disassembly.

The present invention thus allows ease of assembly and disassembly through the use of a single valve check and dispenser lock member shown in the preferred embodiment as U-pin 46, which member not only acts to hold the dispenser 22 to the housing 16, but further acts to check the pump chamber valve 36 and dispenser chamber valve 38. The angle of the conduit 34 relative to the axis of the pump chamber allows for compact structure for the assembly 10, as well as for ease in cleaning the conduit 34 through a pump chamber opening.

Although a preferred embodiment of the invention has been illustrated and described, the invention is not to be limited thereto. It is understood that various modifications and changes in the form and details of the viscous food product dispenser, pump, valve assembly, and valve check and dispenser lock, and their operation, may be made by others with ordinary skill in the art without departing from the spirit of the invention.

What is claimed is:

1. In a container for edible viscous food products such as ketchup, mustard, melted cheese or the like; a housing for a means for pumping and for a means for dispensing, and for a valve apparatus, comprising:

a housing comprising a pump chamber having a first end, with an opening in the first end of the pump chamber sized to removably receive part of the pumping means, and the pump chamber having an inlet opening;

the housing further comprising a dispensing chamber having a first end with an opening in the first end of the dispensing chamber, a passage connecting the pump chamber and dispensing chamber to provide flow communication of viscous food product between the pump chamber and the dispensing chamber;

first valve means associated with the pump chamber for allowing the pump chamber to be in flow communication with the viscous food product in the container during a pumping upstroke and for sealing the pump chamber from flow communication with the viscous food product in the container during a pump downstroke;

second valve means associated with the dispensing chamber for sealing the dispensing chamber from flow communication with the flow passage during a pumping upstroke and for allowing the dispensing chamber to be in flow communication with the passage during a pumping downstroke; and means for checking the movement of the first valve means during pumping intake and means for checking the second valve means during dispensing, comprising the same member, said checking member having at least a first segment and a second segment, the first segment extending into the pump chamber for checking the first valve means, and the second segment extending into the dispensing chamber for checking the second valve means.

2. In the housing for the container for edible viscous food products of claim 1, the housing further comprising the said means for checking the second valve means during dispensing also serving as means for holding the dispensing means to the dispensing chamber.

3. In the housing for the container for edible viscous food products of claim 1, the housing pump chamber having a generally vertical axis and the dispensing chamber having a generally vertical axis, wherein the passage connecting the pump chamber to the dispensing chamber has a first end with an opening that opens into the pump chamber and a second end with an opening that is in flow connection with the dispensing chamber, with the opening at the first end of the said passage positioned below the opening at the second end of said passage, and with said passage extending at an angle of about 48° to about 15° relative to the axis of the pump chamber.

4. In the housing for the container for edible viscous food products of claim 1, the housing pump chamber having a generally vertical axis and the dispensing chamber having a generally vertical axis, wherein the passage connecting the pump chamber to the dispensing chamber has a first end with an opening that opens into the pump chamber and a second end with an opening that is in flow connection with the dispensing chamber, with the opening at the first end of the said passage positioned below the opening at the second end of said passage, the angle of the passage relative to the axis of the pump chamber being about 41°.

5. In the housing for the container for edible viscous food products of claim 1, the housing pump chamber having a generally vertical axis and the dispensing chamber having a generally vertical axis, wherein the passage connecting the pump chamber to the dispensing chamber has a first end with an opening that opens into the pump chamber and a second end with an opening that is in flow connection with the dispensing chamber, with the first end of the said passage positioned below the second end of said passage, the angle of passage relative to the axis of the pump chamber being from about 48° to 5°.

6. In the housing for the container edible viscous food products of claim 1, wherein the means for checking the first valve and second valve means comprises a generally U-shaped pin.

7. In the housing for the container for edible viscous food products of claim 6, the U-pin having a bite section, which bite section rests against a side of the housing when the pin is inserted within the pump chamber and dispensing chamber, the housing having a notch on one side thereof sized to permit the thumb and finger to reach into the notch to grasp the bite section of the U-shaped pin.

8. In the housing for the container for edible viscous food products of claim 1, wherein the housing is a unitary and integral member made of plastic.

9. In the housing for the container for edible viscous food products of claim 1, wherein the means for dispensing comprises a dispensing member having a base, and wherein the dispensing chamber has an offset ledge upon which the dispenser base is supported.

10. In the container for edible viscous food products of claim 3, wherein the pump chamber inlet opening has a center and wherein the passage connecting the pump chamber to the dispensing chamber has an axis which is aligned approximately with the center of the pump chamber inlet opening.

11. In the housing for the container for edible viscous food products of claim 1, wherein the member of the means for checking the movement of the first valve means and second valve means comprises a unitary member.

12. In a container for edible viscous food products such as ketchup, mustard, melted cheese or the like; a housing for a pump comprising a plunger, and for a dispenser having a base and a spout, and for a valve apparatus, comprising:

a pump chamber having a first end, with an opening in the first end of the pump chamber being sized to removably receive the pump plunger;

the housing further comprising a dispensing chamber having a first end with an opening in the first end of the dispensing chamber, the dispensing chamber being sized to receive part of the dispenser base; the housing having a passage connecting the pump chamber and dispensing chamber to provide flow communication of viscous food product between the pump chamber and the dispensing chamber, the passage having a first end with an opening that opens into the pump chamber and a second end with an opening that is in flow connection with the dispensing chamber, with the opening of the first end of the said passage positioned below the opening at the second end of said passage;

first valve means associated with the pump chamber for causing the pump chamber to be in flow communication with the food product in the container during a pump plunger upstroke and sealing the pump chamber from flow communication with the food product in the container during a pump plunger downstroke, said first valve means comprising a first movable ball;

second valve means associated with the dispensing chamber for sealing the dispensing chamber from flow communication with the passage during a pump upstroke and allowing the dispensing chamber to be in flow communication with the flow passage during a pump downstroke, comprising a second movable ball;

means for upwardly checking the movement of the first valve means during pumping intake, and means for checking the second valve means during dispensing and for holding the dispensing means against movement relative to the housing dispensing chamber, comprising a U-shaped pin with a first leg that passes through the housing into the pump chamber with said first leg engaging the first ball during a pump upstroke to check upwardly movement of the first ball, and a second leg which passes through the housing into the dispensing chamber and through the dispenser base to hold the dispenser to the housing, said second leg engaging the second ball during a pump downstroke to check upward movement of the second ball; and the pump chamber having a generally vertical axis and the dispensing chamber having a generally vertical axis, with the flow passage extending at an angle of about 44° to about 38° relative to the axis of the pump chamber.

13. As assembly for pumping and dispensing edible viscous food products having the viscosity of ketchup, mustard, melted cheese or the like, from a container, comprising:

a dispenser comprising a spout and a base connected in flow communication with each other;

a pump;

a housing comprising a pump chamber having a first end, with an opening in said first end to receive part of the pump, and the pump chamber having an inlet opening;

the housing having a dispensing chamber with a first end, said first end of the chamber having an opening which receives the base of the dispenser;

the housing having a conduit connecting the pump chamber to the dispensing chamber, to allow flow communication of viscous food product between the pump chamber and the dispensing chamber, the said conduit having a first end with an opening that opens into the pump chamber and a second end with an opening that is in flow connection with the dispensing chamber, with the opening at the first end of the said conduit positioned below the opening at the second end of said conduit;

a first valve associated with the pump chamber, said valve comprising a moveable ball;

and a second valve associated with the dispensing chamber, said valve comprising a second moveable ball and acting to seal the dispensing chamber from flow communication with the passage during a pump upstroke and allowing the dispensing chamber to be in flow communication with the flow passage during a pump downstroke;

means for checking upward movement of the first ball of the first valve during pumping intake, and for checking movement of the second ball of the second valve during dispensing and for holding the dispenser base against movement relative to the housing dispensing chamber, comprising a pin with a first leg that passes through the housing into the pump chamber and engages the first ball during a pump upstroke to check upward movement of the first ball, the pin also comprising a second leg which passes through the housing into the dispensing chamber and through the dispenser base to hold the dispenser to the housing, the second pin leg checking the movement of the second ball during a pump downstroke;

the pump chamber having a generally vertical axis, with the conduit extending at an angle of about 48° to about 15° relative to the axis of the pump chamber; and the pump chamber inlet opening having a center, and the conduit connecting the pump chamber to the dispensing chamber having an axis that is in alignment approximately with the center of the pump chamber inlet opening.

14. In a container for edible viscous food products such as ketchup, mustard, melted cheese or the like; a housing for a means for pumping and for a means for dispensing, and for a valve apparatus, comprising:

a housing comprising a pump chamber having a first end, with an opening in the first end of the pump chamber sized to removably receive part of the pumping means, and the pump chamber having an inlet opening;

the housing further comprising a dispensing chamber having a first end with an opening in the first end of the dispensing chamber, a passage connecting the pump chamber and dispensing chamber to provide flow communication of viscous food product between the pump chamber and the dispensing chamber;

first valve means associated with the pump chamber for allowing the pump chamber to be in flow communication with the viscous food product in the container during a pumping upstroke and for sealing the pump chamber from flow communication with the viscous food product in the container during a pump downstroke;

second valve means associated with the dispensing chamber for sealing the dispensing chamber from flow communication with the flow passage during a pumping upstroke and for allowing the dispensing chamber to be in flow communication with the passage during a pumping downstroke; and means for checking the movement of the first valve means during pumping intake and means for checking the second valve means during dispensing, comprising a member extending into the pump chamber and into the dispensing chamber, the said means for checking the second valve means during dispensing also serving as means for holding the dispensing means to the dispensing chamber.

15. In the housing for the container for edible viscous food products of claim 14, the dispenser means comprising a base, wherein the said means for checking the second valve means during dispensing and also serving as a means for holding the dispensing means to the dispensing chamber, comprises the said member having a segment that interlocks with the dispenser base and passes into the dispensing chamber.

16. In the container for edible viscous food products of claim 15 wherein the dispensing chamber is sized to receive at least part of the dispenser base, and wherein the member extends through the housing and passes through the part of the dispenser base received within the dispensing chamber, and into the dispensing chamber.

17. In a container for edible viscous food products such as ketchup, mustard, melted cheese or the like; a housing for a means for pumping and for a means for dispensing comprising a base, and for a valve apparatus, comprising:

a unitary and integral housing comprising a pump chamber having a first end, with an opening in the first end of the pump chamber sized to removably receive part of the pumping means, and the pump chamber having an inlet opening;

the housing further comprising a dispensing chamber having a first end with an opening in the first end of the dispensing chamber, a passage connecting the pump chamber and dispensing chamber to provide flow communication of viscous food product between the pump chamber and the dispensing chamber, the passage having a first end with an opening that is in flow connection with the pump chamber and a second end with an opening that is in flow connection with the dispensing chamber, with the opening at the first end of the said passage positioned below the opening at the second end of said passage, the pump inlet opening having a center and the passage having an axis which is aligned approximately with the center of the pump chamber inlet opening, first valve means associated with the pump chamber for allowing the pump chamber to be in flow communication with the viscous food product in the container during a pumping upstroke and for sealing the pump chamber from flow communication with the viscous food product in the container during a pump downstroke;

second valve means associated with the dispensing chamber for sealing the dispensing chamber from flow communication with the flow passage during a pumping upstroke and for allowing the dispensing chamber to be in flow communication with the passage during a pumping downstroke; and means for checking the movement of the first valve means during pumping intake and means for checking the second valve means during dispensing, comprising the same member, said checking member having at least a first segment and a second segment, the first segment extending into the pump chamber for checking the first valve means, and the second segment extending into the dispensing chamber for checking the second valve means.

18. As assembly for pumping and dispensing edible viscous food products having the viscosity of ketchup, mustard, melted cheese or the like, from a container, comprising:

a dispenser comprising a spout;

a pump;

a unitary and integral housing comprising a pump chamber having a first end, with an opening in said first end to receive part of the pump, and the pump chamber having an inlet opening;

the housing having a dispensing chamber with a first end having an opening;

the housing having a conduit connecting the pump chamber to the dispensing chamber, to allow flow communication of viscous food product between the pump chamber and the dispensing chamber, the said conduit having a first end with an opening that is in flow connection with the pump chamber and a second end with an opening that is in flow connection with the dispensing chamber, with the opening at the first end of the said conduit positioned below the opening at the second end of said conduit;

a first valve associated with the pump chamber for allowing the pump chamber to be in flow communication with the viscous food product in the container during pumping intake and for sealing the pump chamber from flow communication with the viscous food product in the container during dispensing;

a second valve associated with the dispensing chamber, said second valve acting to seal the dispensing chamber from flow communication with the passage during pumping intake and allowing the dispensing chamber to be in flow communication with the flow passage during dispensing;

means for checking movement of the first valve during pumping intake, and for checking movement of the second valve during dispensing, comprising a pin with an integral and unitary first leg that passes through the housing into the pump chamber to check the first valve during pumping intake, the pin also comprising an integral and unitary second leg which passes through the housing into the dispensing chamber to check the movement of the second valve during dispensing;

means for holding the dispenser to the housing so that viscous food products can flow from the dispensing chamber through the spout;

the pump chamber having a generally vertical axis, with the conduit extending at an angle of about 48° to about 34° relative to the axis of the pump chamber; and the pump chamber inlet opening having a center, and the conduit connecting the pump chamber to the dispensing chamber having an axis that is in alignment approximately with the center of the pump chamber inlet opening.

19. As assembly for pumping and dispensing edible viscous food products having the viscosity of ketchup, mustard, melted cheese or the like, from a container, comprising:

a dispenser comprising a spout and a base connected in flow communication with each other;

a pump;

a housing comprising a pump chamber having a first end, with an opening in said first end to receive part of the pump, and the pump chamber having an inlet opening;

the housing having a dispensing chamber with a first end, said first end of the chamber having an opening;

means for mounting the dispenser to the housing so that the spout is in flow connection with the dispensing chamber;

the housing having a conduit connecting the pump chamber to the dispensing chamber, to allow flow communication of viscous food product between the pump chamber and the dispensing chamber, the said conduit having a first end with an opening that is in flow connection with the pump chamber and a second end with an opening that is in flow connection with the dispensing chamber, with the opening at the first end of the said conduit positioned below the opening at the second end of said conduit;

a first valve associated with the pump chamber for allowing the pump chamber to be in flow communication with the viscous food product in the container during a pumping intake and for sealing the pump chamber from flow communication with the viscous food product in the container during dispensing;

a second valve associated with the dispensing chamber acting to seal the dispensing chamber from flow communication with the passage during a pump intake and allowing the dispensing chamber to be in flow communication with the flow passage during dispensing;

means for checking the first valve during pumping intake, and for checking the second valve during dispensing and for retaining the dispenser base mounted to the housing to be in flow connection with the dispensing chamber, comprising a unitary and integral pin with a first leg that passes through the housing into the pump chamber to check the first valve during pumping intake, the pin also comprising a second leg which passes through the housing into the dispensing chamber to check the second valve during dispensing, the pin also engaging the dispenser base to retain the dispenser mounted to the housing.

20. The assembly of claim 19 wherein the dispensing chamber receives at least part of the base of the dispenser, wherein the housing is integral and unitary and made of plastic and has a side with a notch sized to permit the thumb and finger to reach into the notch, the pin having a generally U-shape and having a bite section which bite section rests against the said notched side of the housing when the pin is inserted within the pump chamber and dispensing chamber with the part of the pin passing through the dispensing chamber also passing through the dispenser base, so that when the thumb and finger reach into the notch they can grasp the bite section of the U-shaped pin; and the pump chamber having a generally vertical axis, with the conduit extending at an angle of about 48° to about 34° relative to the axis of the pump chamber.

21. The assembly of claim 20 wherein the pump chamber inlet opening has a center, and the conduit connecting the pump chamber to the dispensing chamber has an axis that is in alignment approximately with the center of the pump chamber inlet opening, and wherein the dispensing chamber has a ledge upon which the dispenser base is mounted.

* * * * *